US007164879B2

(12) United States Patent
Benner et al.

(10) Patent No.: US 7,164,879 B2
(45) Date of Patent: Jan. 16, 2007

(54) REVERSIBLE INK CARTRIDGE

(75) Inventors: Robert E. Benner, New Richmond, WI (US); Steven C. Jensen, Maplewood, MN (US); Truman F. Kellie, Lakeland, MN (US)

(73) Assignee: Samsung Electronics Co., Ltd, Suwon (KR)

( * ) Notice: Subject to any disclaimer, the term of this patent is extended or adjusted under 35 U.S.C. 154(b) by 159 days.

(21) Appl. No.: 10/878,766

(22) Filed: Jun. 29, 2004

(65) Prior Publication Data

US 2005/0286935 A1 Dec. 29, 2005

(51) Int. Cl.
*G03G 15/10* (2006.01)

(52) U.S. Cl. ..... 399/237; 399/120

(58) Field of Classification Search ..... 399/119, 399/120, 123, 237, 238, 249, 258, 358–360
See application file for complete search history.

(56) References Cited

U.S. PATENT DOCUMENTS 5,182,601 A * 1/1993 Hodoshima et al. ..... 399/258
6,035,164 A 3/2000 Baek ..... 399/238
2003/0156170 A1 8/2003 Sesek et al. ..... 347/86
2003/0170046 A1 9/2003 Sato et al. ..... 399/109
2003/0231906 A1 12/2003 Yoshizawa ..... 399/281

* cited by examiner

*Primary Examiner*—David M. Gray
*Assistant Examiner*—Erika J. Villaluna
(74) *Attorney, Agent, or Firm*—Mark A. Litman & Associates, P.A.

(57) ABSTRACT

A printer cartridge for electrographic printing (dry or liquid) is provided with two chambers connected by a developer transportation system that traverses a development zone in a first direction. As the toner (developer) from a first of the two compartments is fed through the development zone, excess or unused toner is transported by the developer transportation system into a second of the two compartments. When the first compartment has exhausted its supply of toner, there will be sufficient toner captured in the second compartment to allow for printing capability to be maintained in the system, without any replenishment. The direction of flow of developer during printing is reversed from the second compartment to the first compartment, passing through the development zone.

13 Claims, 4 Drawing Sheets

REVERSIBLE INK CARTRIDGE

BACKGROUND OF THE INVENTION

1. Field of the Invention

The present invention relates to an electrophotographic or printer cartridge and a method of using the cartridge. The invention also relates to the conservation of inks and ink materials and the reduction of wasted ink material.

2. Background of the Art

Conventional electrophotographic image forming processes typically include electrophotographic copying machine, an electrophotographic printer (for example, LED printer, laser beam printer, and the like), an electrophotographic facsimile, an electrophotographic word processor, which may use liquid inks, toners, developers, or solid powder toner and the like. In an electrophotographic image forming apparatus, a process cartridge system has long been employed. According to this system, an electrophotographic photoconductive member, and a single or plurality of processing means, which act on the electrophotographic photoconductive member, are integrated into a form of a cartridge removably mountable in the main assembly of the image forming apparatus. This system enables a user to maintain the apparatus without relying on a service person, immensely improving the operability of the apparatus. Thus, the process cartridge system has been widely used in the field of an image forming apparatus.

The electrophotographic cartridge assists in forming an image on recording medium with the use of dry or wet developer (ink, toner or developer are common names for the included material) contained therein. The amount of the developer in the cartridge is gradually depleted with image formation, eventually providing a level of developer below which the printer fails to form an image satisfactory in quality to the user who purchased the cartridge. At this point, the process cartridge loses its commercial value.

It has often been observed that there is significant material wastage on cartridge use, which has led to strict regulations on the disposal of cartridges. Additionally, the cost of using and disposing of cartridges/image effectively increases when material remains unused in the cartridge due to the highly regulated nature of the unused development material.

There are many different formats for cartridges in the industry. Most printers have unique designs to motivate users to purchase cartridges specific for their machines. Among the many designs is the one shown in Published U.S. patent application No. 20030231906 which rotates the cartridge within the printer to deliver developer to the charged image surface.

Published U.S. patent application No. 20030156170 describes an imaging media cartridge for use in an imaging apparatus that includes a first imaging media reservoir chamber and a second imaging media reservoir chamber. A removable barrier is disposed between the first imaging media reservoir chamber and the second imaging media reservoir chamber. By removing the removable barrier, a reserve of imaging media can be provided from the second imaging media reservoir chamber to the first imaging media reservoir chamber. In one embodiment the imaging media cartridge is a toner cartridge. In another embodiment the imaging media cartridge is a liquid ink cartridge.

Published U.S. patent application No. 20030170046 describes a developing device that includes a holding chamber for holding developing agent, a port for accessing the holding chamber from outside the developing device, and a developing agent bearing member that bears developing agent from the holding chamber. After the developing device has been used until the holding chamber has run out of developing agent, the used developing device is refilled with developing agent. The port is opened to access the holding chamber. The type of previously-used developing agent that remains in the holding chamber from the preceding developing operation usage is determined. The previously-used developing agent is removed to an amount of 1.2 g or less per centimeter of the axial length of the developing agent bearing member. Then, a type of developing agent that has a lower fluidity characteristic, a lower melting characteristic, or both, than the previously-used developing agent is determined. Then, the holding chamber is refilled with the designated type of developing agent. Afterward, the port is closed.

U.S. Pat. No. 6,035,164 describes a refill cartridge for a wet electrophotographic printer. The refill cartridge, for supplying ink to an ink cartridge fixed in a printer main body having a hollow area therein, includes: a case having an air hole and an ink supply hole, for detachable installation in the hollow area; a disk slidably mounted within the case; a spring for elastically biasing the disk toward the ink supply hole; and an ink supply hole plug capable of opening and closing the ink supply hole. In this case and similar cases, the toner is supplied to the development cartridge from a hose connected to a supply tank; the developer is usually moved via gravity or (more commonly) by the use of a pump). Once the developer is in the developer cartridge, it must either remain there until it is used, or another pump must be used to transport the developer back to the storage tank.

SUMMARY OF THE INVENTION

A printer cartridge for electrographic printing (dry or liquid) is provided with two chambers connected by a developer transportation system that traverses a development zone in a first direction. As the toner (developer) from a first of the two compartments is fed through the development zone, excess or unused toner is transported by the developer transportation system into a second of the two compartments. When the first compartment has exhausted its supply of toner, there will be sufficient toner captured in the second compartment to allow for printing capability to be maintained in the system, without any replenishment. The direction of flow of developer during printing is reversed from the second compartment to the first compartment, passing through the development zone.

Additional developer or replenishment material (e.g., carrier liquid) may be provided to the captured developer from reservoirs within the compartment or by external addition through a port.

DETAILED DESCRIPTION OF THE INVENTION

Figure 1:
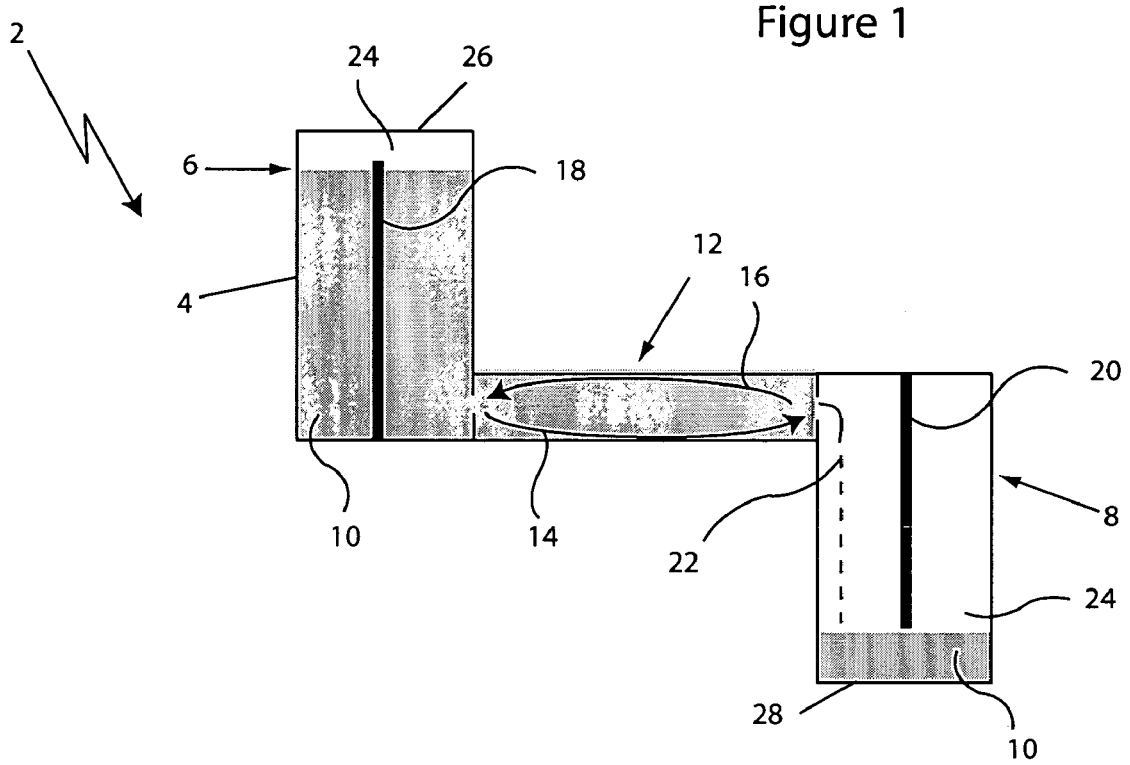
FIG. 1 shows a schematic of a Development cartridge according to technology described herein in a first delivery position.

In electrophotographic printing systems, especially in such systems that use a liquid developer, it is necessary to regularly, if not continually mix or agitate the developer. For liquid-type electrophotographic systems, charged toner particles are dispersed a carrier liquid. In order to maintain the dispersion properly, frequent mixing or agitation is required. Current systems use pumps to circulate the developer either in the development cartridge itself or between the development cartridge and a supply tank. The pumps present several problems: First, the pumps produce heat that can cause the carrier liquid to evaporate; Second, the constant pumping of the liquid developer can act on the size of the charged toner particles therein, reducing them to an ineffective size; Third, multiple pumps provide multiple opportunities for mechanical failure; and Fourth, the inclusion of many pumps can increase the cost of the printer hardware or consumables.

In dry electrophotographic systems, particularly those using two-component dry toner systems, the carrier (which supplies the charge) needs to be dispersed throughout the toner particles. To this end, augers or tumblers are frequently used to agitate the toner and maintain the correct ratio of toner particles to carrier.

In both liquid and dry systems, it is common to have to remove and replace the entire development cartridge when the developer supply is depleted.

In the present invention, a printer cartridge for electrographic printing (dry or liquid) is provided with two chambers connected by a developer transportation system that traverses a development zone in a first direction. The transportation system, as described later in greater detail, may be a tube system, venting system, pump system, gravity system or the like that is essentially closed to direct ambient contact with the environment (that is, the transportation system does not move the developer with developer directly exposed to the atmosphere, as in a closed system). During the printing process and particularly during the development step, the toner (developer) from a first of the two compartments is fed through the development zone (e.g., normal developer feeding systems in printers may be used), and excess or unused toner is transported by the developer transportation system into a second of the two compartments. The delivery of the developer into the second of the two compartments may be assisted by gravity, flow pumps, air flow, or any other mass transfer forces. The developer is collected in the second compartment in a manner that prevents its escape into the general environment. For example, a closing lip or flap (one way feed), or the like may be used to close off the second compartment when developer is not being delivered to or from the second compartment. When the first compartment has exhausted its supply of toner, there will be sufficient toner captured in the second compartment to allow for printing capability to be maintained in the system, without any replenishment. The direction of flow of developer during printing is reversed from the second compartment to the first compartment, passing through the development zone.

Detection of the level of toner in the first compartment (or the second compartment) may be accomplished by any sensing method. Weight sensing, level sensing, electrical property sensing (as shown in U.S. patent application Ser. No. 10/285,385, which is incorporated herein by reference in its entirety) or any other method that can indicate the level of or exhaustion of the developer in a compartment can be used.

The transportation system between the two compartments has basically a number of desirable performance functions. The transportation system must be able to deliver the developer from a compartment (beginning with the first compartment) to the development area in a traditional printing format. The transportation system should avoid allowing the transportation path of the developer from the first compartment to the development area to the second compartment from being exposed to the ambient environment (e.g., air outside of the printer housing). The system should also be able to reverse the flow of developer from the second compartment, across the development area, and into the first compartment. This can be done by reversing the mass transfer forces alone, or in combination with physically reversing the relation of the first and second compartments. Reversing the relationship can be done by a number of ways. One way is by having a functionally symmetrical arrangement of the two compartments so that the cartridge can be removed from the printer, the second compartment positioned in the location of the first compartment and the first compartment positioned in the original location of the second compartment, and inserted into operating position. The positioning of the compartments within a single cartridge structure may also be rotatable or be capable of being swiveled to exchange the relative position of the compartments with respect to a development zone. There may be a fixed feed direction from the location of the original first compartment to the second compartment, or the feed direction may be reversible.

The original second compartment may be provided with some developer already therein so that the addition of excess or overflow developer from the first compartment will provide a more full second compartment when the first compartment has been exhausted and/or to assure that the composition in the second compartment is essentially a composition close to that of the original developer composition in the first compartment. The original compositions in the first and second compartments may be initially different, with the composition in the second compartment being provided to balance out loss of materials during transportation of the developer through the developer area. For example, it would be expected that there would be a greater loss of volatile materials during the transportation, so the composition in the second compartment, based on predetermined expected loss of volatile liquid, would have a higher volatile liquid concentration in the original second compartment developer. Additional developer or replenishment material (e.g., carrier liquid) may be provided to the captured developer from reservoirs within the compartment or by external addition through a port to provide a similar composition stabilizing effect.

An optional feature of the development cartridge of the presently described technology includes a removable compartment. One or both of the ink compartments (or tanks) maybe removable, such that when one or both are empty (i.e. the developer has been completely drained into the other compartment or tank), it may be removed and replace with a new, full compartment or tank. In this embodiment, a sensor, such as one described above, may signal the user that the developer is in need of replenishment. The user may then simply exchange the drained compartment for a fresh one. One advantage of this embodiment is that the entire cartridge does not have to be replaced, allowing the hardware included for development to remain in the unit. Another advantage of this embodiment is that the unused developer that was not left in a sufficient quantity for printing will now be left in the unit to mix with the fresh developer. Essentially, the user will never have to dispose of unused developer for the life of the printer.

Reference to the Figures will help in further appreciating this technology.

FIG. 1 shows a schematic of a development cartridge 2 according to technology described herein in a first delivery position. The cartridge 2 comprises a first compartment 4 that is filled to level 6 with developer, a development zone 12, and a second compartment 8 shown in this non-limiting example with a small amount of developer 10 already therein. There is a material transport path 14 that is used in moving developer 10 between the first compartment 4 across the developer area 12 and then to the second compartment 8. There are volume/amount sensors 18 and 20 in the compartments 4 and 8, respectively. Excess developer 10 is shown in a stream 22 entering the second compartment 8. The space 24 within the second compartment 8 contains ambient gas, such as air and volatiles from the developer 10. The top 26 of the first compartment 4 is in an uppermost position, and the bottom 28 of the second compartment 8 is in a lowermost position. If the cartridge 2 were not to be moved, a pumping or mass transfer system (not shown) would have to be able to move developer 10 in the second compartment 8 back across the developing area 12 along developer movement path 16 after the developer 10 was depleted from the first compartment 4.

Figure 2:
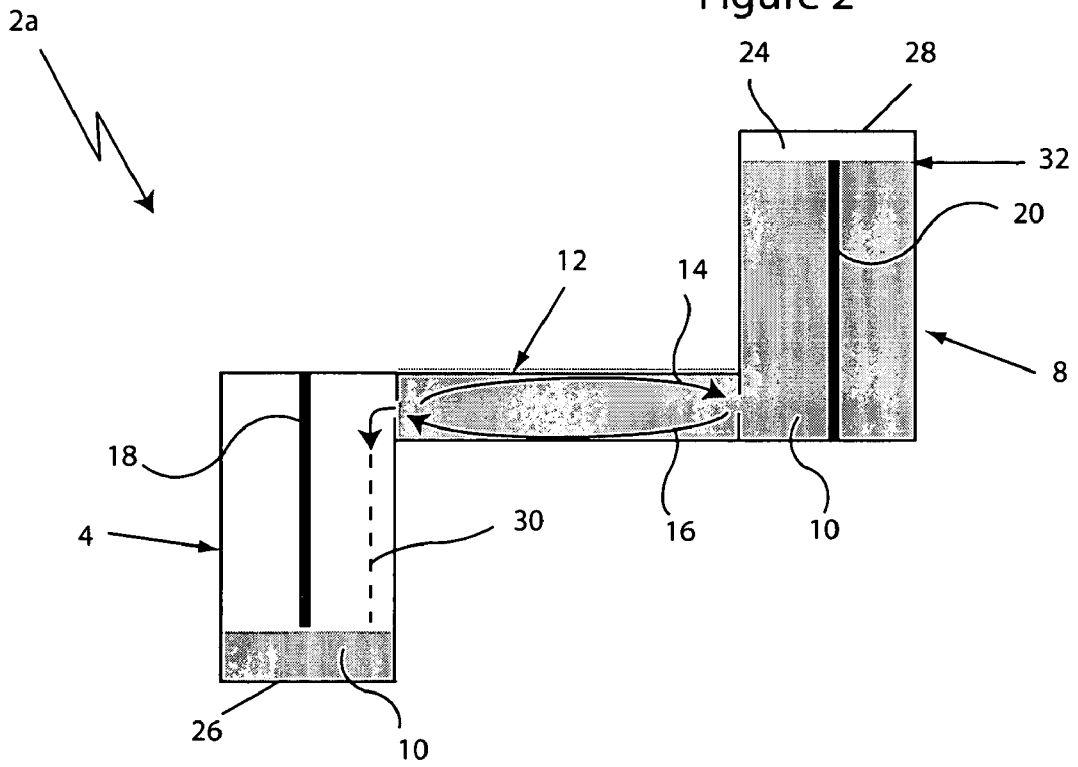
FIG. 2 shows a schematic of a Development cartridge according to technology described herein in a second, return delivery position.

FIG. 2 shows a schematic of a development cartridge 2*a* according to technology described herein in a second, return delivery position. What was the bottom 28 of the second compartment 8 has now been rotated to a topmost position to use gravity as a mass transfer force to move toner along mass transfer path 16. Toner is now shown entering the first compartment 4 as a stream 30. The sensors 18 and 20 can provide information to a processor or controller as to when such a rotation should be done, which may be automatically performed by the printer or done by an operator manually. The system may indicate how many times a specific cartridge has been rotated, and may limit the number of times that a cartridge may be rotated. Information may be stored on a chip on the cartridge to indicate the number of times of rotation, or any other memory storage procedure may be practiced to that end.

Figure 3:
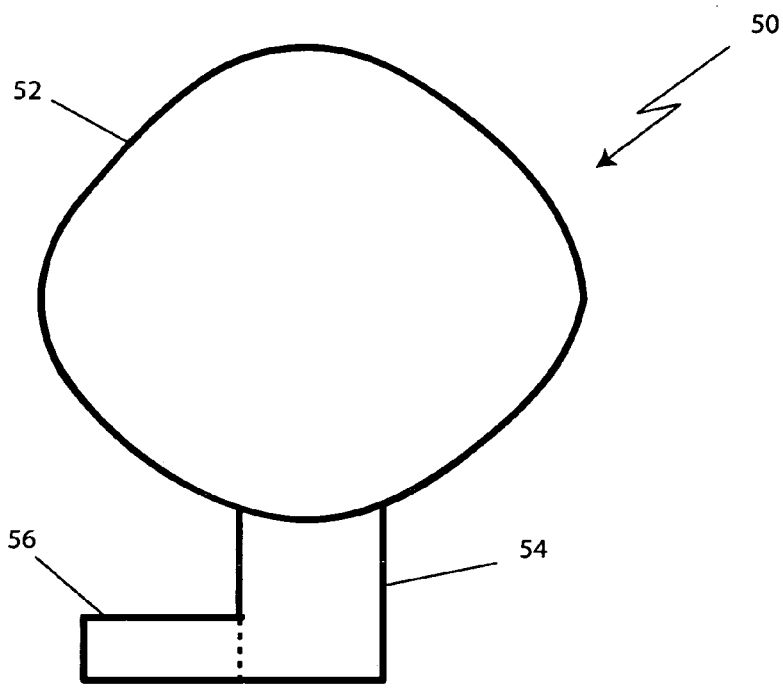
FIG. 3 shows an ink-containing bladder delivery system for a cartridge according to technology described herein.

FIG. 3 shows an ink-containing bladder 52 delivery system 50 for a cartridge according to technology described herein. The bladder 52 is subjected to pressure to move toner out of the bladder 52, through a rotary union 54 (which allows the delivery system 50 to rotate for reversing) and into an ink outlet 56 leading to the developer area (not shown).

Figure 4:
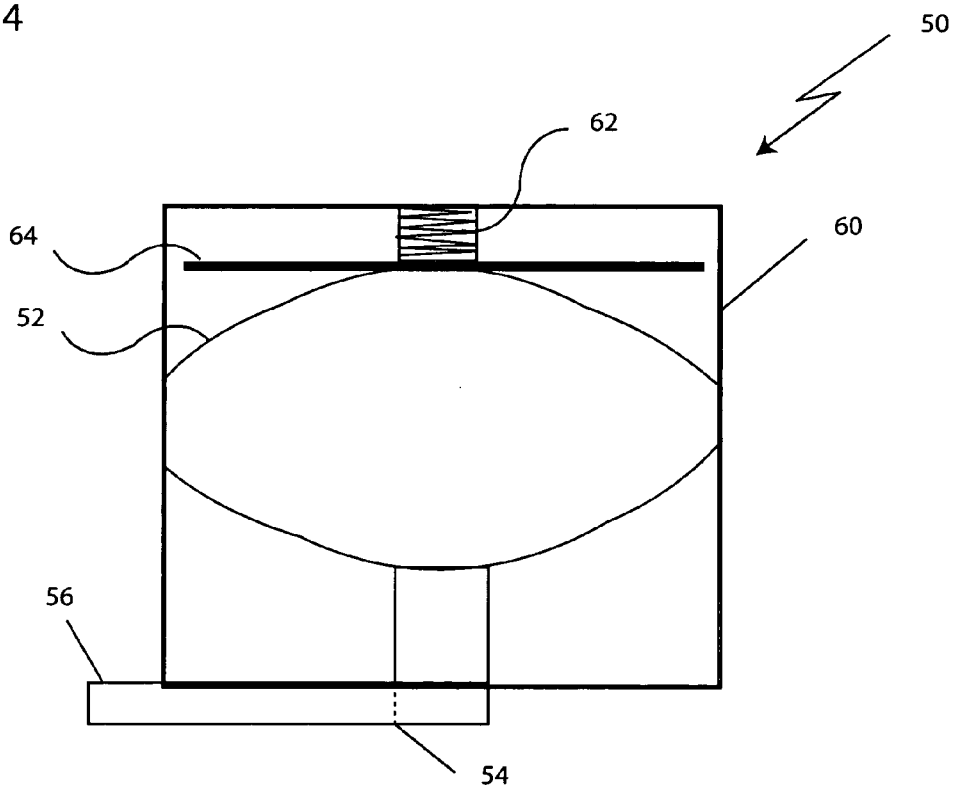
FIG. 4 shows an ink-containing bladder delivery system for a cartridge with reversible flow features according to technology described herein.

FIG. 4 shows an ink-containing bladder delivery system 50 that may optionally be included in the development cartridge of FIG. 1, inside of an ink tank 60 for a cartridge with reversible flow features according to technology described herein. A plate 64 may optionally be used to apply a constant light pressure to the bladder to ensure that gravity substantially depletes the developer in the bladder 52. In this embodiment, when the tank 60 is inverted, the plate 64 will not interfere with the refilling of the bladder 52. A further embodiment of the ink-containing bladder delivery system may comprise use of a spring 62 to provide a positive pressure against the bladder 52 through a pusher or plate 64.

Figure 5:
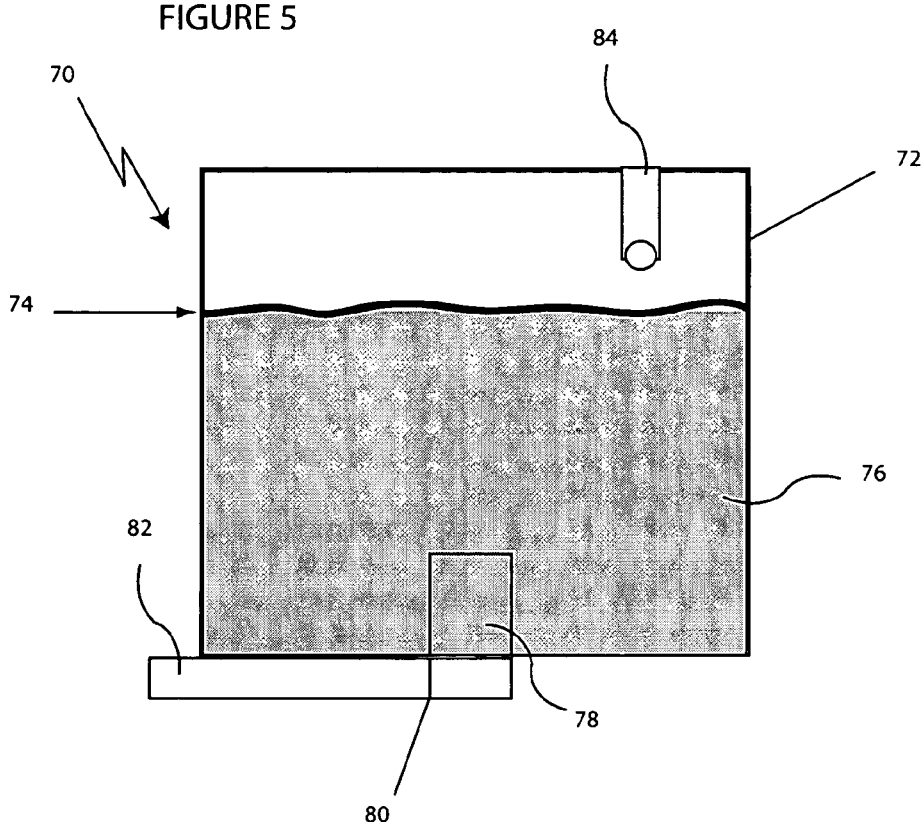
FIG. 5 shows a gravity feed developer system using technology described herein.

FIG. 5 shows a gravity feed developer system 70 using technology described in herein. The ink tank 72 contains toner 76 at a toner level of 74. The toner 76 passes into a drain 78 by gravity feed, through the rotary union 80 and into the ink outlet 82 to the developer area (not shown). A snorkel-and-plug-type element 84 allows the ink tank 72 to be rotated without the toner 76 exiting the snorkel, which acts as a volatiles vent, air intake vent, and pressure equalizing vent as needed.

Figure 6:
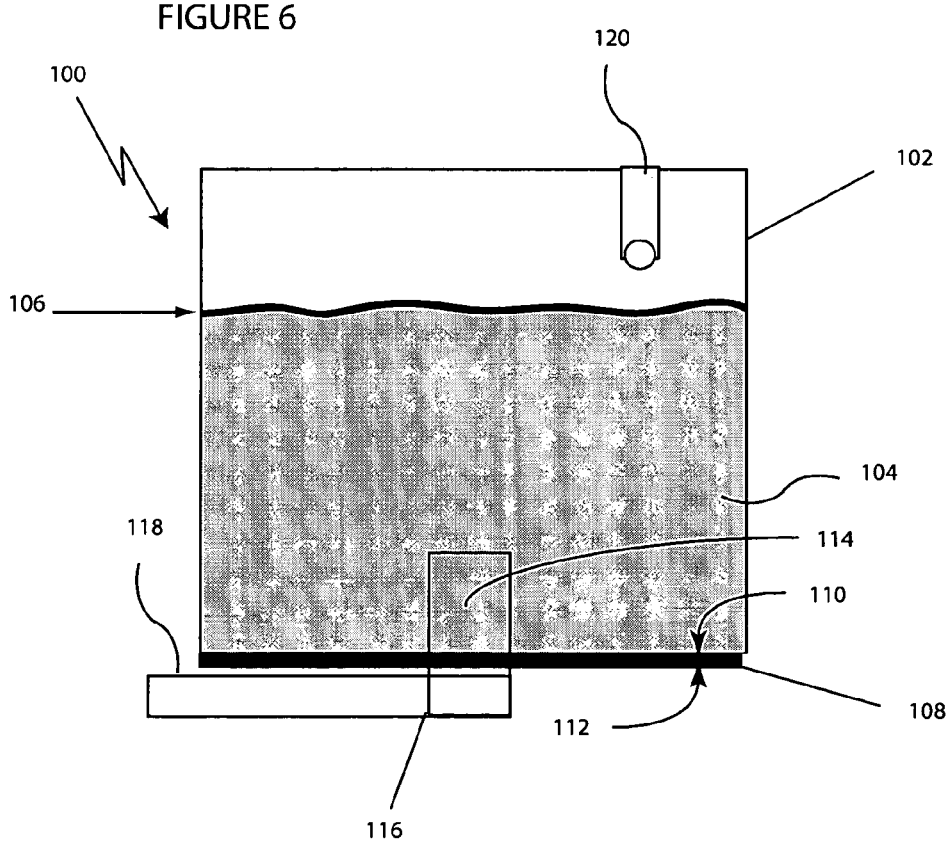
FIG. 6 shows a phase change developer system using technology described in herein.

FIG. 6 shows a phase change developer cartridge system 100 using technology described herein. The cartridge system 100 has an ink tank 102, phase transition toner 104, at toner level 106. A Peltier coupler 108 is provided to soften the phase transition toner 104 so that it can pass into a drain 114 by gravity feed, through the rotary union 116 and into the ink outlet 118 to the developer area (not shown). A snorkel-and-plug-type element 120 allows the ink tank 102 to be rotated without the toner 104 exiting the snorkel 120, which acts as a volatiles vent, air intake vent, and pressure equalizing vent as needed. The hot side 110 of the Peltier coupler 108 faces the phase transition toner 104 and the cold side 112 of the Peltier coupler faces away from the phase transition toner.

Figure 7:
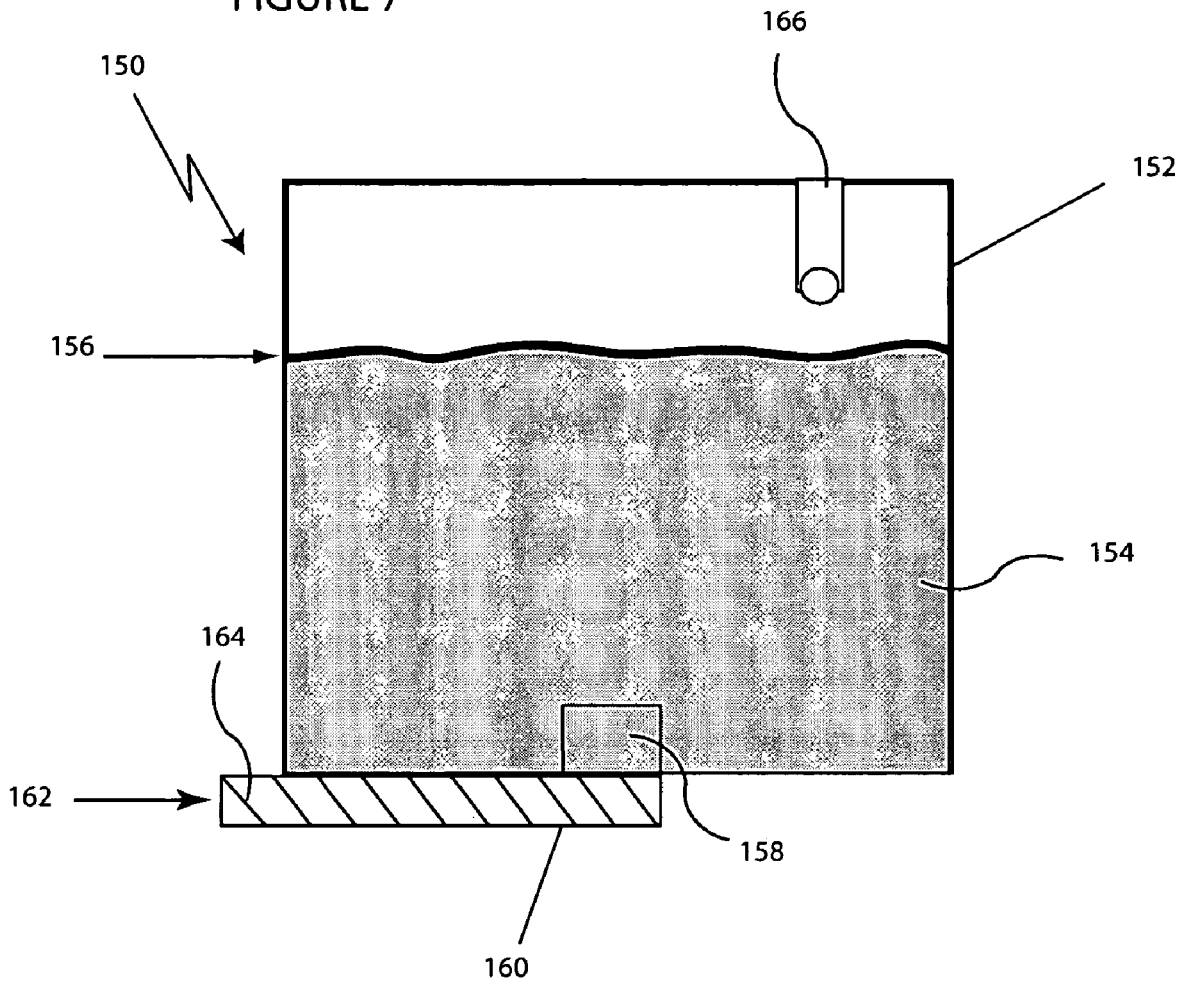
FIG. 7 shows a dry toner developer cartridge system using technology described herein.

FIG. 7 shows a dry toner developer cartridge system 150. The dry toner system 150 comprises the ink tank 152 containing dry toner 154 at toner level 156. A drain or hole pipe 158 allows the dry toner 154 to be gravity fed into a rotary union 160 which leads to the dry toner outlet 162. An auger or other physical mass movement system 164 is within the dry toner outlet 162 to assure movement of dry toner.

These and other aspects, features, and advantages of the present invention will become more apparent upon consideration of the following description of the-preferred embodiments of the present invention, taken in conjunction with the accompanying drawings.

What is claimed:

1. A printer system for electrophotographic imaging comprising a first toner-containing compartment and a second toner-containing compartment, and a developer area between the first toner-containing compartment and the second toner-containing compartment, toner transportation system that moves toner from the first compartment into the developer area and then into the second toner-containing compartment in a first direction, the printer system being able to reverse the toner transportation system so that it moves toner from the second compartment into the developer area and then into the first toner-containing compartment in a second direction, wherein the toner is a liquid toner.

2. The printer system of claim 1 wherein the second direction is essentially opposite the first direction.

3. The printer system of claim 1 wherein relative positions of the first toner-containing compartment and the second toner-containing compartment are exchanged so that the second direction is essentially the same as the first direction.

4. The printer of claim 3 wherein a self-closing vent is provided on one of the top side or bottom side of each of the first toner compartment and the second toner compartment.

5. The printer of claim 3 wherein a self-closing vent is provided on one of the top side or bottom side of each of the first toner compartment and the second toner compartment.

6. The printer of claim 3 wherein liquid toner is present within a flexible bladder within a compartment.

7. A printer system for electrophotographic imaging comprising a first toner-containing compartment and a second toner-containing compartment, and a developer area between the first toner-containing compartment and the second toner-containing compartment, toner transportation system that moves toner from the first compartment into the developer area and then into the second toner-containing compartment in a first direction, the printer system being able to reverse the toner transportation system so that it moves toner from the second compartment into the developer area and then into the first toner-containing compartment in a second direction, wherein the toner is a phase change toner and a surface of the compartment containing the toner comprises a Peltier unit to heat the phase change toner.

8. A printer system for electrophotographic imaging comprising a first liquid toner-containing compartment and a second liquid toner-containing compartment, and a developer area between the first liquid toner-containing compartment and the second liquid toner-containing compartment, toner transportation system that moves liquid toner from the first liquid compartment into the developer area and then into the second liquid toner-containing compartment in a first direction, the printer system being able to reverse the liquid toner transportation system so that it moves liquid toner from the second liquid toner-containing compartment into the developer area and then into the first liquid toner-containing compartment in a second direction, wherein at least one of the liquid toner-containing compartments is removable so that a new compartment can replace an original compartment.

9. A method of printing with a toner comprising providing toner from a first toner-containing compartment to a second toner-containing compartment, and developing an image in a developer area that is between the first toner-containing compartment and the second toner-containing compartment, transporting toner with a toner transportation system from the first compartment into the developer area and then into the second toner-containing compartment in a first direction, reversing the toner transportation system so that the toner transportation system moves toner from the second compartment into the developer area and then into the first toner-containing compartment in a second direction, wherein the toner is a liquid toner.

10. The method of claim 9 wherein reversing is done by exchanging relative positions of the first toner compartment and the second toner compartment.

11. The method of claim 9 wherein reversing is done by reversing mass transfer forces that transported toner in a first direction so that the toner is driven in a second direction.

12. The method of claim 11 wherein reversing mass transfer forces is accomplished by changing the relative potential energy of toner between the first toner compartment and the second toner compartment.

13. A self contained flow-reversible liquid toner cartridge comprising a first liquid toner-containing compartment and a second liquid toner-containing compartment, and a developer delivery area between the first liquid toner-containing compartment and the second liquid toner-containing compartment, liquid toner being moveable from the first liquid toner-containing compartment into the developer area where liquid toner can be delivered outside of the cartridge and then excess liquid toner can pass into the second liquid toner-containing compartment in a first direction, the cartridge being able to reverse direction of liquid toner flow from the second liquid compartment into the developer area and then into the first liquid toner-containing compartment in a second direction.

* * * * *